US006502804B1

(12) United States Patent
Schwegler et al.

(10) Patent No.: US 6,502,804 B1
(45) Date of Patent: Jan. 7, 2003

(54) DEVICE FOR OPERATING A GAS SHUTTLE VALVE BY MEANS OF AN ELECTROMAGNETIC ACTUATOR

(75) Inventors: Roland Schwegler, Wenstadt (DE); Thomas Stolk, Kirchheim (DE); Dirk Stubel, Stuttgart (DE); Alexander Von Gaisbert, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/462,159

(22) PCT Filed: Jul. 1, 1998

(86) PCT No.: PCT/EP98/04067

§ 371 (c)(1),
(2), (4) Date: Jan. 5, 2000

(87) PCT Pub. No.: WO99/02823

PCT Pub. Date: Jan. 21, 1999

(30) Foreign Application Priority Data

Jul. 5, 1997 (DE) ..... 197 28 479

(51) Int. Cl.[7] ..... F01L 9/04

(52) U.S. Cl. ..... 251/129.1; 251/129.16; 251/129.19; 123/90.11

(58) Field of Search ..... 251/129.16, 129.19, 251/129.1; 123/90.11, 90.55

(56) References Cited

U.S. PATENT DOCUMENTS

| | | | | |
|---|---|---|---|---|
| 5,261,610 A | * | 11/1993 | Waryu et al. | 251/129.19 |
| 5,704,314 A | * | 1/1998 | Allmendinger et al. | 123/90.11 |
| 5,762,035 A | * | 6/1998 | Schebitz | 123/90.11 |
| 5,785,016 A | * | 7/1998 | Enderle et al. | 123/90.11 |
| 6,101,992 A | * | 8/2000 | Pischinger et al. | 123/90.11 |

FOREIGN PATENT DOCUMENTS

| | | |
|---|---|---|
| DE | 19511880 | 10/1995 |
| DE | 19624296 | 6/1996 |
| JP | 86307/1988 | 6/1988 |

OTHER PUBLICATIONS

Copy of Japanese office action with English translation dated Jun. 20, 2001.

* cited by examiner

*Primary Examiner*—Henry C. Yuen
*Assistant Examiner*—John Bastianelli
(74) *Attorney, Agent, or Firm*—Crowell & Moring LLP

(57) ABSTRACT

A device for operating a gas shuttle valve through an electromagnetic actuator secured and mounted in a component which has an opening and a closing magnet with an axially displaceable armature between the opening and closing magnet. The armature acts through the use of an armature plunger in conjunction with a spring system on a valve stem. A play-compensation element is arranged between the armature plunger and the valve stem.

10 Claims, 3 Drawing Sheets

DEVICE FOR OPERATING A GAS SHUTTLE VALVE BY MEANS OF AN ELECTROMAGNETIC ACTUATOR

BACKGROUND AND SUMMARY OF THE INVENTION

BACKGROUND OF THE INVENTION

1. Field of the Invention

The invention relates to actuators for a charge-cycle device.

2. Discussion of Background

Electromagnetic actuators for activating charge-cycle valves usually have two switching magnets, an opening magnet and a closing magnet, between whose pole faces an armature is arranged so as to be displaceable coaxially with respect to an axis of the charge-cycle valve. The armature acts on a valve stem of the charge-cycle valve directly or via an armature bolt. In the case of actuators according to the principle of the oscillating mass, a prestressed spring mechanism, usually two prestressed compression springs, acts on the armature, specifically an upper and a lower valve spring. The upper valve spring acts in the opening direction and the lower valve spring acts in the closing direction of the charge-cycle valve. When the switching magnets are not energized, the armature is held by the valve springs in an equilibrium position which preferably corresponds to the geometric centre between the switching magnets.

When the actuator is started, the closing magnet or the opening magnet is briefly overexcited or the armature is made to oscillate by means of an oscillation-excitation routine in order to attract the armature out of the equilibrium position. In the closed position of the charge-cycle valve, the armature bears against the pole face of the energized closing magnet and is held by it. The closing magnet prestresses the valve spring acting in the opening direction. In order to open the charge-cycle valve, the closing magnet is switched off and the opening magnet is switched on. The valve spring acting in the opening direction accelerates the armature beyond the equilibrium position so that the latter is attracted by the opening magnet. The armature strikes against the pole face of the opening magnet and is held tight by it. In order to be able to close the charge-cycle valve again, the opening magnet is switched off and the closing magnet is switched on. The valve spring acting in the closing direction accelerates the armature beyond the equilibrium position to the closing magnet. The armature is attracted by the closing magnet, strikes against the pole face of the closing magnet and is held tight by it.

Variables which have not been taken into account from the start onwards or which change over time, such as for example fabrication tolerances of individual components, thermal expansion of different materials etc., may lead to a situation in which the armature no longer completely comes to bear against the pole faces of the magnets, play arises between the armature plunger and the valve stem and/or the charge-cycle valve no longer completely closes.

From application, DE 19 647 305.5, a play-compensation element is known in which an actuator is floatingly mounted in a cylinder head. The actuator opens and closes a charge-cycle valve by means of an armature and two electromagnets which are arranged on either side in the direction of movement of the armature. On the side facing away from the charge-cycle valve there is between a cover plate and the actuator a play-compensation element which compensates both positive and negative valve play.

The play-compensation element has a first hydraulic element with a play-compensation piston in a cylinder. The play-compensation piston lies between a first pressure space, which is controlled as a function of the internal combustion engine and faces away from the charge-cycle valve, and a second pressure space which faces the charge-cycle valve. In the piston there is a non-return valve which is held in the closed position by means of a retaining spring. The non-return valve opens in the direction of the second pressure space when there is excess pressure in the first pressure space. The retaining spring is configured in such a way that the non-return valve cannot open if there is no play present, and thus closes the connection between the two pressure spaces.

Between the play-compensation piston and the cylinder there is a defined amount of play as a throttle connection through which pressure medium can escape to the outside from the second pressure space. The play-compensation element is supported on the upper cover plate which is permanently connected to the cylinder head. The play-compensation element can only transmit compressive forces.

If the charge-cycle valve does not close correctly because the actuator is displaced too far in the direction of the charge-cycle valve, i.e. there is negative play, a pressure increase comes about in the second pressure space as a result of a valve spring of the charge-cycle valve which acts in the direction of the closed position. This pressure increase has the effect that the pressure medium can escape from the second pressure space via the throttle connection, specifically until the charge-cycle valve closes completely again.

If the charge-cycle valve closes correctly, but there is play between the armature plunger and the charge-cycle valve, the valve spring of the charge-cycle valve no longer acts on the second pressure space. The pressure in the second pressure space thus drops below that in the first pressure space with the result that the non-return valve opens counter to the retaining spring. Pressure medium flows from the first pressure space into the second pressure space until the play is compensated. This compensation takes place over a plurality of working cycles of the valve.

The play-compensation element is pushed into just one hole in the actuator so that both parts can be displaced with respect to one another and are therefore easy to mount. The actuator is relieved of loading by a reaction force in the direction of the charge-cycle valve during the entire time in which the closing magnet is activated in order to close the charge-cycle valve. In addition, the play-compensation element is relieved of loading as soon as the armature strikes against the pole face of the opening magnet. When the play-compensation element is relieved of loading, it expands. If the actuator of the charge-cycle valve opens, an opposed reaction force comes about and the play-compensation element is blocked with respect to the force in accordance with its function and can only slowly yield. It may happen that the play-compensation element expands more and more, and the charge-cycle valve no longer closes completely. A type of surging effect is produced. The result of this may be, for example, that the charge-cycle valve no longer closes correctly and in the process burns. Furthermore, the switching magnet may require an increased level of energy in order to attract the armature out of its off-centre position. In addition, a so-called stroke loss occurs in which the actuator is displaced counter to the movement of the charge-cycle valve during the closing procedure.

According to a further variant from the prior art, the play-compensation element is permanently connected to the actuator and can thus absorb tensile forces and compressive forces. The play-compensation element of this second variant has, in addition to the first hydraulic element, a second hydraulic element with a cylinder in which the first cylinder is guided with a ring-like expanded portion. The ring-like expanded portion serves at the same time as a separating piston between an upper and a lower pressure chamber which are connected via an annular throttle gap. For the rest, the play-compensation element is of the same design as the variant which has been described previously.

If the charge-cycle valve is closed by means of the actuator, the reaction force is transmitted to the lower pressure chamber via the first cylinder. Since the reaction force lasts only a brief time, there is no significant compensation of pressure medium between the. upper pressure chamber and the lower pressure chamber. The actuator does not move. However, positive and negative play can be compensated over a plurality of valve cycles.

For reasons of space, the charge-cycle valves are installed in a skewed arrangement in which they diverge from one another in the direction of the actuator. One cover plate with seals and screw set must be provided per charge-cycle valve and actuator.

The valve springs displace the actuator slowly upwards when the switching magnets are not energized, as a result of which the armature is displaced out of its geometric centre position between the pole. faces of the switching magnets. In the case of the play-compensation element which can be subjected to tensile and compressive loading, depending on its function the second hydraulic element can become locked back into the centre -position, against rapid compensation. The centre position is reached only after a plurality of cycles under certain circumstances. This results in turn, for example, in an increased energy requirement and the risk of not being able to hold the charge-cycle valve because it strikes against the pole face of the closing magnet with an excessively high speed, and bounces off it again or is not accelerated sufficiently closely to the opening magnet by the upper valve spring.

DE 33 11 250 A1 discloses a device for activating a charge-cycle valve with an electromagnetic actuator in which arranged between an armature and a valve stem is a play-compensation element which can transmit only compressive forces. The play-compensation element is hermetically sealed off and does not have a pressure port via which it is supplied with pressure medium.

Patent application DE 196 24 296 A1 discloses a device for activating a charge-cycle valve with an electromagnetic actuator in which a play-compensation element is arranged between an armature plunger and a valve stem. The play-compensation element is inserted into a cup plunger which is arranged between the armature plunger and the valve stem and which is itself guided in a baseplate of the actuator casing so as to be displaceable in the axial direction of the valve. An oil supply duct, which is connected to the hydraulic play-compensation element via a circumferential groove on the cup plunger and a lateral hole runs in the baseplate.

The supply of the pressure media is a problem in the known play-compensation elements. According to DE 196 24 296 A1, the media are supplied laterally through the cup plunger which has to be guided in the baseplate with seals. The structural possibilities of supplying the pressure media in such a way are limited. Furthermore, guiding the cup plunger in a sealed fashion brings about additional or increased friction in the guide faces.

SUMMARY OF THE INVENTION

The object of the present invention consists in designing a charge-cycle device with a play-compensation element in such a way that the pressure media can be supplied in a way which is improved in terms of the friction conditions or the structural possibilities.

According to the invention, a hydraulic play-compensation element is connected to a pressure port by means of a duct in the longitudinal direction in the armature plunger. The pressure medium is supplied via a suitable transfer point to the armature plunger and from there via the duct to the play-compensation element. This measure makes it possible for the location where the pressure medium is fed to be displaced between a stationary housing component and a component of the play-compensation element which moves with the charge-cycle valve, for example to any desired locations of the armature plunger.

Preferably, the play-compensation element is used without guidance. As a result, the friction influences of the guidance of the play-compensation element, for example the energy which is dissipated by the friction and/or adhesion/sliding effects between the guide and the play-compensation element, which can give rise to deviations from the desired movement of the valve, are dispensed with.

According to a further refinement of the invention, it is proposed that the play-compensation element should be connected to the pressure port only in the area just in front of the closed position and in the closed position. The length dimension which is equivalent to how far the play-compensation element must expand, in the first instance, for the charge-cycle valve to form a good seal, with its valve plate, against the valve seat ring and, in the second instance, for the armature to come to bear precisely on the pole face of the closing magnet is obtained only if the charge-cycle valve is closed, i.e. bears with its valve plate against a valve seat ring.

Further details of the invention and the resulting advantages can be found in the following description of exemplary embodiments. Numerous features are presented as described in conjunction in the description and in the claims. The person skilled in the art will expediently also consider the features individually and combine them to form further useful combinations.

DETAILED DESCRIPTION OF THE PREFERRED EMBODIMENTS

Figure 1:
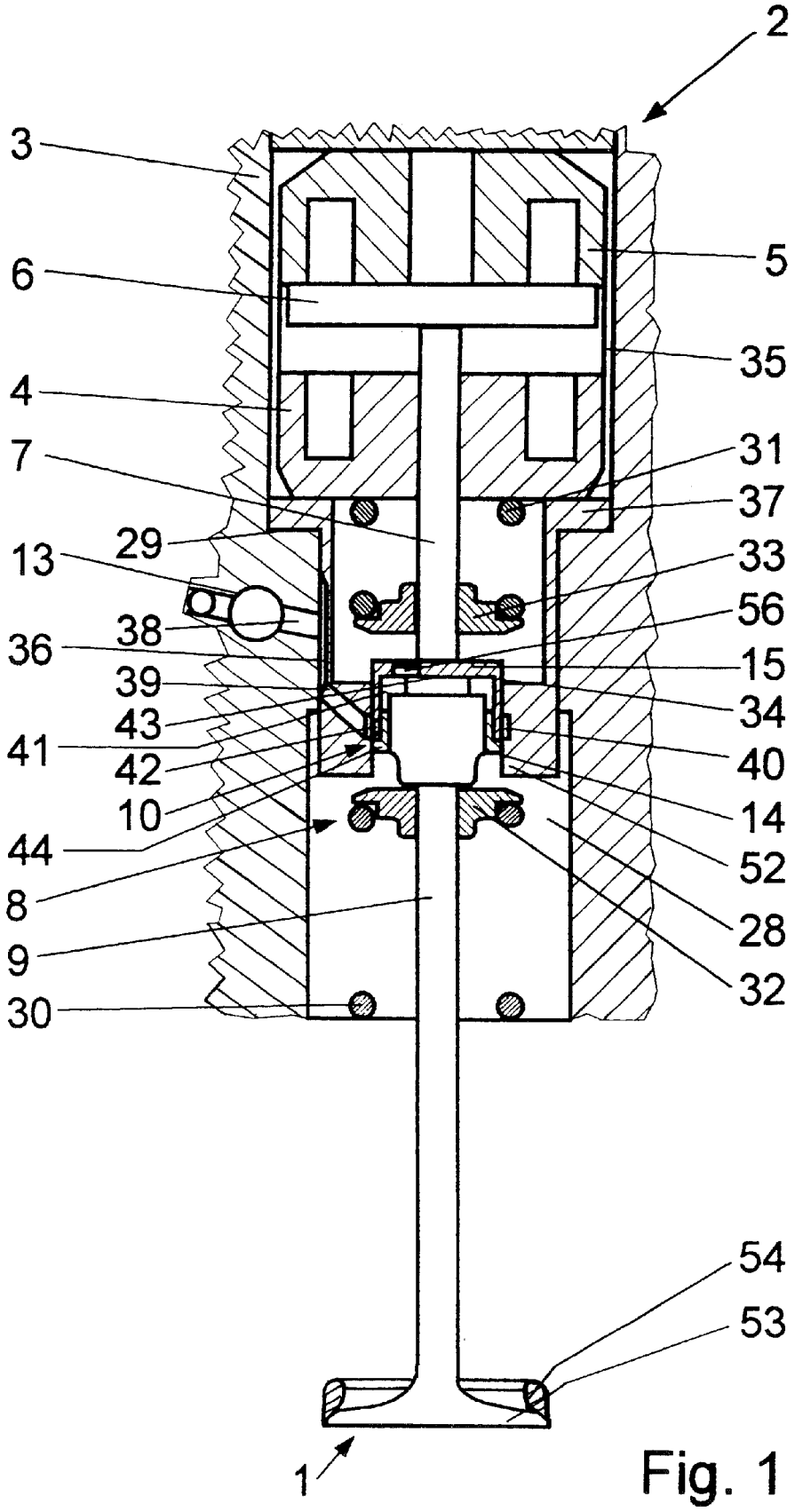
FIG. 1 shows an electromagnetic actuator and a charge-cycle valve with a play-compensation element which is connected to a pressure port.

FIG. 1 shows an actuator 2 for activating a charge-cycle valve 1 which is permanently mounted in a recess 35 in a component 3, for example in an actuator carrier or in a cylinder head. The actuator 2 has an opening magnet 4 and a closing magnet 5, between which an armature 6 is arranged in an axially displaceable fashion. The armature 6 is attached to an armature plunger 7 or embodied in one piece therewith and it interacts with said armature plunger 7 on a valve stem 9 of the charge-cycle valve 1. In addition, the actuator 2 has a spring system 8 underneath the opening magnet 4 with a lower valve spring 30, acting in the closing direction, and with an upper valve spring 31, acting in the opening direction. The lower valve spring 30 is supported on the component 3 in the direction of the charge-cycle valve 1 and on a spring plate 32, attached to the valve stem 9, in the direction facing away from the charge-cycle valve 1. The upper valve spring 31 is supported on a spring plate 33, attached to the armature plunger 7, in the direction of the charge-cycle valve 1, and on the opening magnet 4 in the direction facing away from the charge-cycle valve 1. The valve springs 30, 31 are prestressed to such an extent that when the switching magnets 4, 5 are de-energized the armature 6 is set to an approximately center position between the switching magnets 4, 5, and there is a residual closing force of the lower valve spring 30 directly in front of the closed position of the charge-cycle valve 1, and a residual opening force of the upper valve spring 31 directly in front of the opened position.

A hydraulic play-compensation element 10 is clamped in between the armature plunger 7 and the valve stem 9 by the prestress of the valve springs 30, 31. The play-compensation element 10 is supplied with pressurized oil via a cup 15 which is arranged between the play-compensation element 10 and the armature plunger 7, partially surrounds the play-compensation element 10 with its side elements 34 and is led outwards by means of sliding friction in a guide 14 which is fed by oil pressure and is fixed to the cylinder head.

The guide 14 is formed by a separate component 52 which is inserted into the recess 35 in the component 3. The component 52 bears with its outer circumference against the inner contour of the recess 35 and is supported by means of a collar 37 on the opening magnet 4 in the direction facing away from the charge-cycle valve 1, and on a step 29 in the component 3 or in the cylinder head in the direction of the charge-cycle valve 1. The component 52 has on its outer circumference a pressure space 36 via which it is connected to a pressure port 13 via a duct 38. A duct 39 leads from the pressure space 36 to the guide 14. and opens into an annular groove 40. Just in front of the closed position, and in the closed position, of the charge-cycle valve 1, an inner space 41 which is formed between the cup 15 and the play-compensation element 10 is connected to the annular groove 40 via a duct 42 in the cup 15. The play-compensation element 10 is guided radially by means of a guide 44. The armature 6 with its armature plunger 7, the play-compensation element 10 and the charge-cycle valve 1 can be installed in a rotationally symmetrical fashion. The annular groove 40 ensures that the cup 15 is supplied with oil irrespective of the alignment during mounting. The pressurized oil is then fed to the play-compensation element 10 from above via a recess 56 on an inner cover side 43 of the cup 15 if necessary. The supplying of pressurized oil via. cups 15 is a mature technique, which is thus subject to few problems. However, it is also possible to feed the pressurized oil, with or without cup 15, directly to the side of a play-compensation element which is of appropriate design. The play-compensation element can also be guided directly in the component 3.

Figure 2:
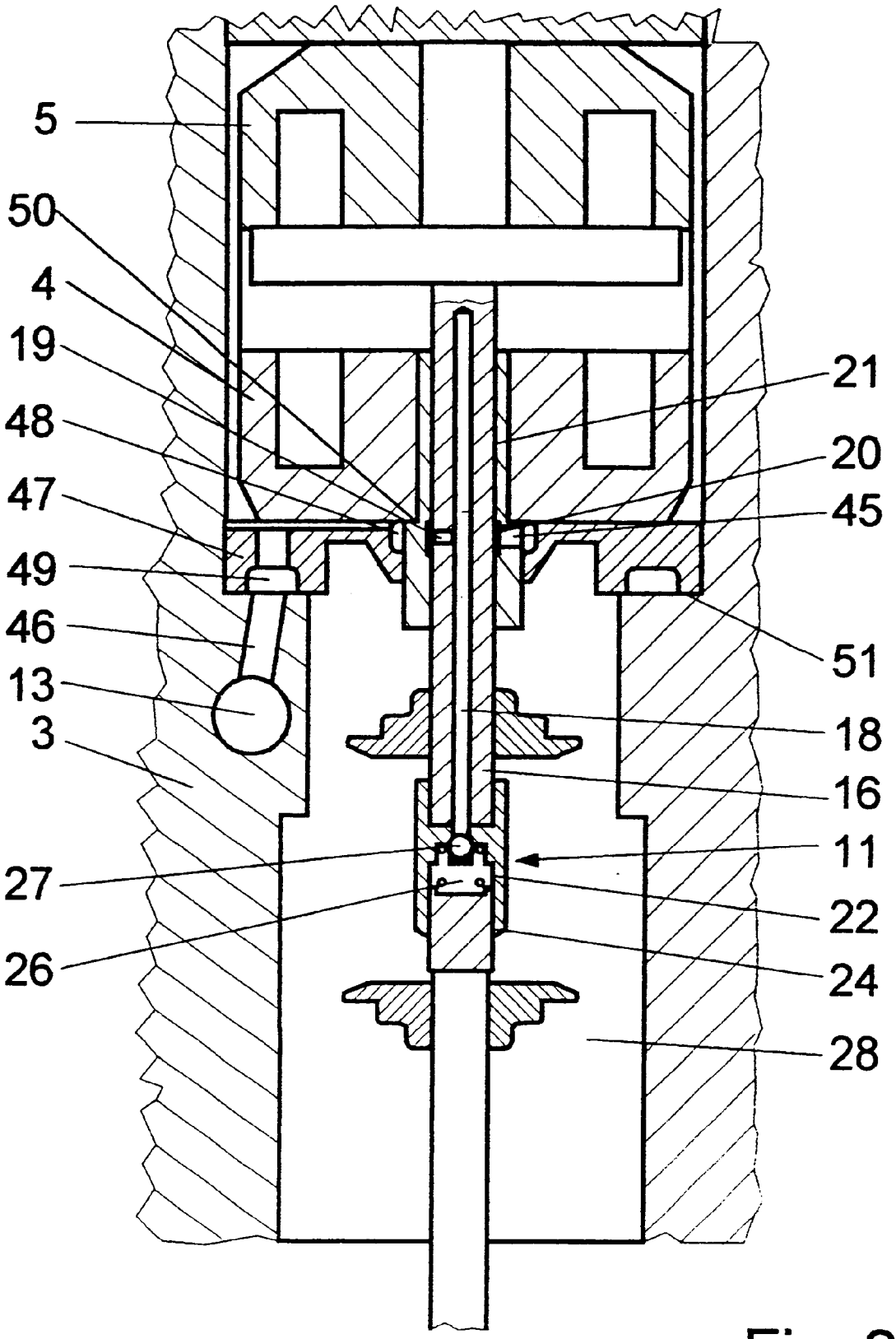
FIG. 2 shows an actuator according to the exemplary embodiment in FIG. 1, in which the play-compensation element is connected to the pressure port by means of a duct in the armature plunger.

FIG. 2 illustrates a refinement of the invention in which a play-compensation element 11 is supplied with pressurized oil by means of a duct 18 which extends in the longitudinal direction in an armature plunger 16 and is connected to the pressure port 13. A guide 21 for the play-compensation element 11, and in particular a cup 15, is not necessary. The friction at the play-compensation element 11 is eliminated and the mass which is moved becomes smaller.

The pressurized oil is fed from the pressure point 13 via a duct 46 to a ring 47 underneath the opening magnet 4 via an annular groove 49 on the end side pointing towards the charge-cycle valve 1. Within the ring 47 it is conducted to a second annular groove 48 which is arranged on the inner circumference of the ring 47. The ring 47 is supported on a step 51 in the component 3 in the direction of the charge-cycle valve 1, and on the opening magnet 4 in the direction facing away from the charge-cycle valve 1, and the opening magnet 4 is supported on the ring 47, as a result of which the ring 47 can be positioned precisely in the longitudinal direction. Underneath the opening magnet 4, the distance from the play-compensation element 11 is relatively short, and the pressurized oil can be supplied favourably without impeding the movement of the armature 6. The annular groove 48 is adjacent on the inside to a guide 21 of the armature plunger 16, said guide 21 being inserted into the opening magnet 4. In the vicinity of the annular groove 48, the guide 21 has a transverse duct 45 which opens inwardly with respect to the armature plunger 16, in an annular groove 20. Just in front of the closed position, and in the closed position, a transverse duct 19, connected to the duct 18, in the armature plunger 16 comes to rest in the guide 21 by means of the annular groove 20. The play-compensation element 11 is thus connected to the pressure port 13 just in front of the closed position, and in the closed position, and is supplied with pressurized oil in order to expand to an appropriate length if necessary.

By means of the annular grooves 49, 48 and 20, the ring 47, the guide 21 and the armature plunger 16 can be installed rotationally symmetrically, irrespective of the alignment, as a result of which mounting is made easier. In addition, a contribution is made to simple mounting by the fact that the guide 21 is secured in the longitudinal direction by a step 50 on the opening magnet 4, enabling the transverse duct 45 to be positioned easily and precisely in the guide 21 in the longitudinal direction during mounting. The ring 47 can be embodied as a single part; however, it can also be formed integrally to the opening magnet 4 and thus form an integral component.

The duct 18 can also be connected to the pressure port 13 in other regions such as in the guide 21 of the armature plunger 16, for example in the case of a continuous duct 18 from the direction of the closing magnet 5 etc. However, the guide 21 is particularly suitable for this because a friction face which is present is used, i.e. there is no new one added and this is additionally lubricated with pressurized oil and the friction is thus reduced.

The play-compensation element 11 has a cylinder 22 and a piston 24 between which a pressure space 26 is enclosed. The pressure space 26 is connected to an adjacent space 28 via a throttle (not illustrated), to a spring space and to the duct 18 via a non-return valve 27.

The play-compensation element 11 is embodied as a stand-alone, operationally capable unit which is plugged onto the armature plunger 16 and can thus be premounted and checked in advance. Preferably, the play-compensation element 11 can be plugged on easily and is nevertheless of captive design, for example by means of an 0-ring (not illustrated) which engages in an annular groove etc.

Figure 3:
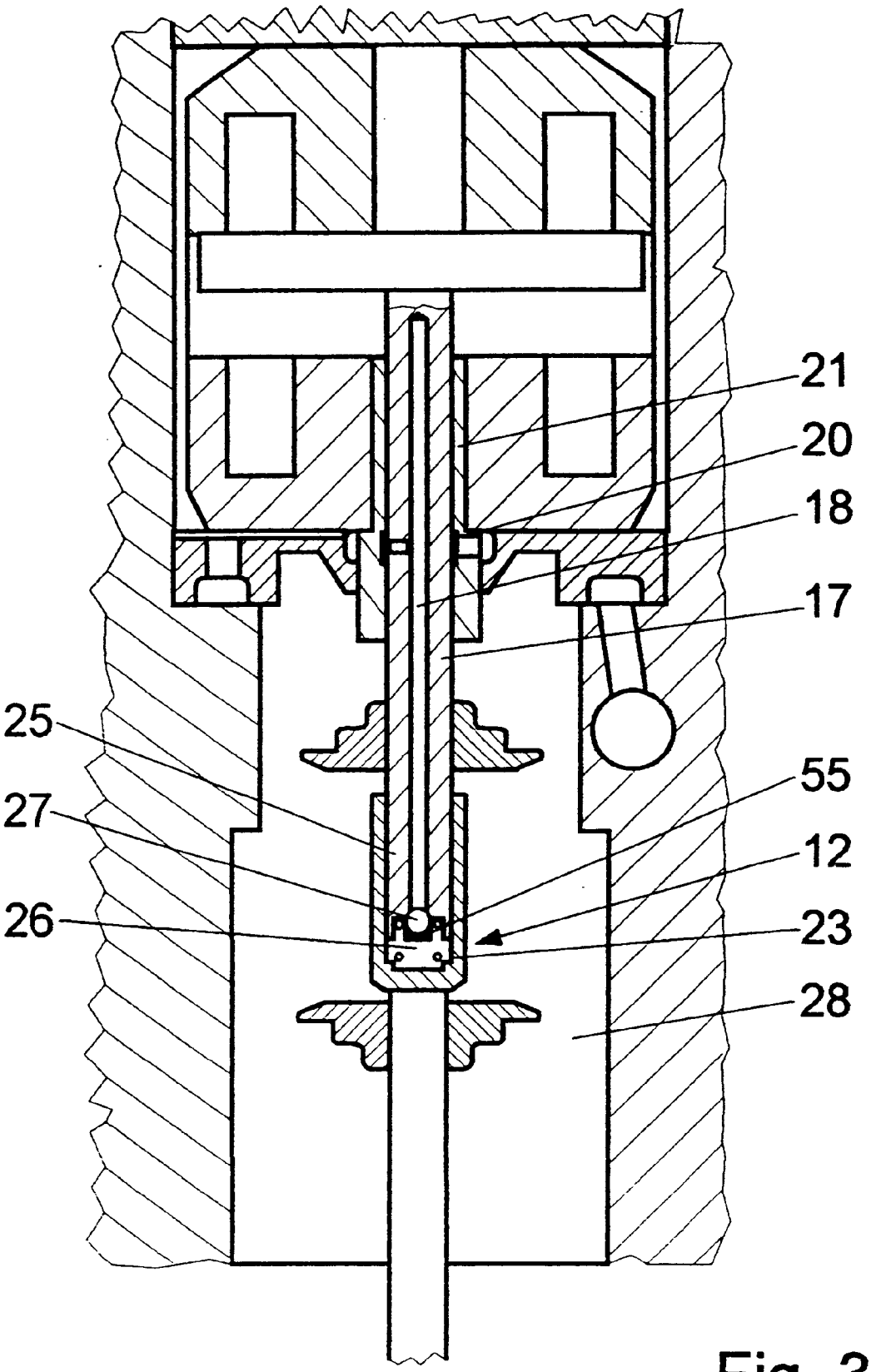
FIG. 3 shows an actuator according to the exemplary embodiment in FIG. 2, in which the armature plunger forms part of the play-compensation element.

FIG. 3 illustrates a play-compensation element 12 in which a piston 25 is formed by part of the armature plunger 17. Just one type of cylinder 23 is pushed over the armature plunger 17, between which cylinder 23 and the armature plunger 17 the pressure space 26 is formed. The non-return valve 27 is inserted into a recess 55 in the armature plunger 17. The play-compensation element 12 can be embodied in a more economical and lightweight fashion. The mass which is moved is reduced. It is also possible for the valve stem 9 to form parts of the play-compensation element 12, for example in that the cylinder 23 is embodied in one piece with the valve stem 9, i.e. the play-compensation element 12 could, with the exception of the non-return valve 27, be formed completely by the armature plunger 17 and the valve stem 9.

When the actuator 2 is started, in the first closed position of the charge-cycle valve 1, the play-compensation element 10, 11, 12 is set to its precise length, i.e. the armature 6 comes to bear precisely on the pole face of the closing magnet 5, and a valve plate 53 of the charge-cycle valve 1 forms a complete seal against a valve seat ring 54. During the entire operation, the play-compensation element 10, 11, 12 is under compressive stress and has a tendency to become shorter so that it always reliably closes by virtue of the fact that oil flows continuously into the spring space via a throttle. If the play-compensation element 10, 11, 12 has become too short owing to the leakage, said element is reset to the exact length in the closed position of the charge-cycle valve 1 in that the non-return valve 27 opens and the pressure space 26 is connected to the pressure port 13. As a result of this iterative process, the charge-cycle valve 1 moves continuously in a region of optimum play without the play-compensation element 10, 11, 12 surging.

The charge-cycle valves must always reliably close. In order to achieve this, the play-compensation elements on which the charge-cycle valves are supported directly or indirectly have the tendency to continuously slowly shorten themselves. This is achieved in hydraulic play-compensation elements with a corresponding throttle point. If the armature no longer comes sufficiently close to the closing magnet, because the play-compensation device has shortened itself too much, a rapid compensation must take place in the opposite direction, which compensation is carried out with an opening non-return valve. Such an iterative process with a rapid compensation and with a slow compensation has the effect that the charge-cycle valve moves continuously in a range of optimum play setting.

Having a play-compensation element with a pressure port ensures rapid refilling via the non-return valve. In addition, the play-compensation element is scavenged with engine oil, which is exchanged after certain intervals. Air and condensation bubbles are eliminated by means of the scavenging process, and there is always functionally capable oil in the play-compensation element.

The play-compensation element is clamped in between the armature plunger and the valve stem between an upper valve spring, acting in the opening direction, and a lower compression spring, acting in the closing direction. Both valve springs are thus prestressed to such an extent that when the switching magnets are de-energized, the armature moves into an approximately centre position between pole faces of the switching magnet, and at the same time a residual closing force of the lower valve spring acts on the play-compensation element, the armature plunger and on the armature into the closed position, or just in front of the closed position, of the charge-cycle valve. If the armature is attracted by the closing magnet just in front of its pole face, and the kinetic energy of the armature is ignored, the closing magnet has to apply the spring force of the upper valve spring, acting in the opening direction, minus the residual closing force of the lower valve spring, acting in the closing direction. The same force which the closing magnet has to apply acts as an opposite reaction force at the actuator. This force relieves of loading the play-compensation element from the prior art and gives rise, inter alia, to the surging effect. On the other hand, in the case of the play-compensation element between the armature plunger and the valve stem there is continuously a compressive stress at least at the level of the residual closing force, as a result of which surging is largely avoided.

The actuator has a much larger mass than the charge-cycle valve with its valve stem, or the armature with its armature plunger. In the refinement according to the invention, the play-compensation element only has to move the small mass of the armature or of the charge-cycle valve between the armature plunger and the actuator, with the result that a surging effect which occurs only to a small degree can be compensated through controlled leakage without the play-compensation element becoming too weak as a result of an excessively large quantity of leakage oil.

In order to move the heavy actuator, a high energy demand is necessary. In the invention, the actuator is permanently mounted and only the small masses of the armature with its armature plunger or of the charge-cycle valve with its valve stem are moved by the play-compensation element, as a result of which there is a saving in energy.

As a result of the fixed mounting of the actuator, for example in a cylinder head or in an actuator carrier, relatively costly, floating mounting is avoided. In addition, the play-compensation element can easily be fitted onto the valve stem after the charge-cycle valve has been mounted, or said play-compensation element can be premounted with the actuator.

In the arrangement according to the invention of the play-compensation element between the armature plunger and the valve stem, the play-compensation elements with just one hydraulic element can be used, i.e. elements which absorb only compressive forces and no tensile forces. This ensures that after a restart, the equilibrium position of the armature which is determined by the spring system comes to be set quickly and precisely back to the geometric centre position between the pole faces of the opening magnet and those of the closing magnet. When the play-compensation element is first relieved of loading, i.e. in the first closed position of the charge-cycle valve, the play-compensation element becomes adjusted to the precise length without a second hydraulic element blocking the process.

Reproducible valve stroke curves are achieved. The charge-cycle valves reliably close in a precise way which is optimized in terms of noise, and the actuators can be mounted with the play-compensation elements in an easy and quick way with little structural complexity.

What is claimed is:

1. A charge-cycle device comprising:

a charge-cycle valve having a valve stem;

and an electromagnetic actuator positioned in a mounting component, said actuator having an opening magnet and a closing magnet with an armature positioned between said opening and closing magnet and wherein said armature is arranged to be axially displaceable with the armature being controlled by an armature plunger together with a prestressed spring system which includes an opening spring and a closing spring on said valve stem; and a hydraulic play-compensation element positioned between the armature plunger and the valve stem supplied with a pressure medium via a pressure port;

said armature plunger including in a longitudinal direction, a duct whereby said duct provides for the connection of said play-compensation element to said pressure port;

wherein said play-compensation element has a pressure space which is enclosed between a cylinder and a piston and is connected to said pressure port through a non-return valve and is also connected to an adjacent space through a throttle.

2. The charge-cycle device according to claim 1, wherein said play-compensation element is connected to said pressure port in a region in front of a closed position and in a closed position of said charge-cycle valve.

3. The charge-cycle device according to claim 1, wherein said duct is closed in the direction of the armature and is connected to said pressure port by means of a lateral duct beneath said opening magnet.

4. The charge-cycle device according to claim 1, wherein said lateral duct is connected to said pressure port by means of an annular groove.

5. The charge-cycle device according to claim 1, wherein said duct is connected to said pressure port by means of an guide in said armature plunger.

6. The charge-cycle device according to claim 1, wherein at least one of said armature plunger) and said valve stem form at least part of said play-compensation element.

7. The charge-cycle device according to claim 1, wherein said armature plunger forms said piston of said play-compensation element.

8. The charge-cycle device according to claim 1, wherein the play-compensation element is inserted without a guide.

9. Method of activating charge-cycle valves having a valve stem, the method comprising the steps of;

positioning an electromagnetic actuator in a mounting component wherein said actuator has an opening and closing magnet;

positioning an armature to be axially displaceable between said opening and closing magnet;

controlling said armature by an armature plunger and a prestressed spring system wherein said spring system includes an opening spring and a closing spring on said valve stem;

providing a hydraulic play-compensation structural element and supplying said element with a pressure medium through a pressure port; and providing said armature plunger with a duct in a longitudinal direction for connecting said play-compensation element to said pressure port; and and providing said play-compensation element with a pressure space enclosed between a cylinder and a piston, wherein said play-compensation element is connected to said pressure port through a non-return valve and is also connected to an adjacent space through a throttle.

10. A charge-cycle device comprising;

a charge-cycle valve having a valve stem;

actuator means position in a mounting component for activating said charge-cycle valve, said actuator means including an opening and closing magnet means;

an axially displaceable armature means positioned between said opening and closing magnet;

control means for controlling said armature means wherein said control means includes a spring means on said valve stem; and hydraulic valve play-compensation structure supplied with a pressure medium through a pressure port; and wherein said armature means includes in a longitudinal direction a duct means for connection of said valve play-compensation structure to said pressure port;

wherein said play-compensation element has a pressure space which is enclosed between a cylinder and a piston and is connected to said pressure port through a non-return valve and is also connected to an adjacent space through a throttle.

* * * * *